United States Patent [19]

Ikeda

[11] Patent Number: 4,691,527

[45] Date of Patent: Sep. 8, 1987

[54] CONTROL DEVICE FOR REFRIGERATED DISPLAY CASE

[75] Inventor: Hideo Ikeda, Isesaki, Japan

[73] Assignee: Sanden Corporation, Gunma, Japan

[21] Appl. No.: 807,844

[22] Filed: Dec. 11, 1985

[30] Foreign Application Priority Data

Dec. 11, 1984 [JP] Japan ..... 59-186708[U]
Dec. 11, 1984 [JP] Japan ..... 59-186709[U]

[51] Int. Cl.[4] ..... F25D 21/00; F25B 47/00

[52] U.S. Cl. ..... 62/234; 62/197; 62/199; 62/278; 62/256

[58] Field of Search ..... 62/278, 81, 196.4, 197, 62/198, 199, 200, 256, 151, 152, 155, 234, 158, 277

[56] References Cited

U.S. PATENT DOCUMENTS 3,122,892 3/1964 Beckwith ..... 62/256 X
3,465,536 9/1969 Vogel et al. ..... 62/158
4,122,688 10/1978 Mochizuki et al. ..... 62/278 X

*Primary Examiner*—Harry B. Tanner
*Attorney, Agent, or Firm*—Banner, Birch, McKie & Beckett

[57] ABSTRACT

A refrigerated display case with multiple air curtains and a refrigerating apparatus for refrigerating circulating air. The refrigerating apparatus includes a compressor, a condenser and two evaporators. The suction sides of both evaporators are connected with one another by a first passage line which includes first and second compression device with check valves in series, this line being connected to the compressor through valve devices. The discharge sides of both evaporators are also connected with one another by a second passage line which includes a pair of check valves, this second line being connected to the compressor through valve devices, respectively. The first and second passage lines are connected with one another and connected to the condenser through a valve device whereby both evaporators are parallel or serial connected with one another due to operation of the valve devices to accomplish the refrigerating mode or refrigerating and defrosting mode of the refrigerating means. A control apparatus is also provided to control the operation of the valve devices. The operating mode of the refrigerating apparatus is controlled to reduce the large load initially put on the refrigerating apparatus.

18 Claims, 5 Drawing Figures

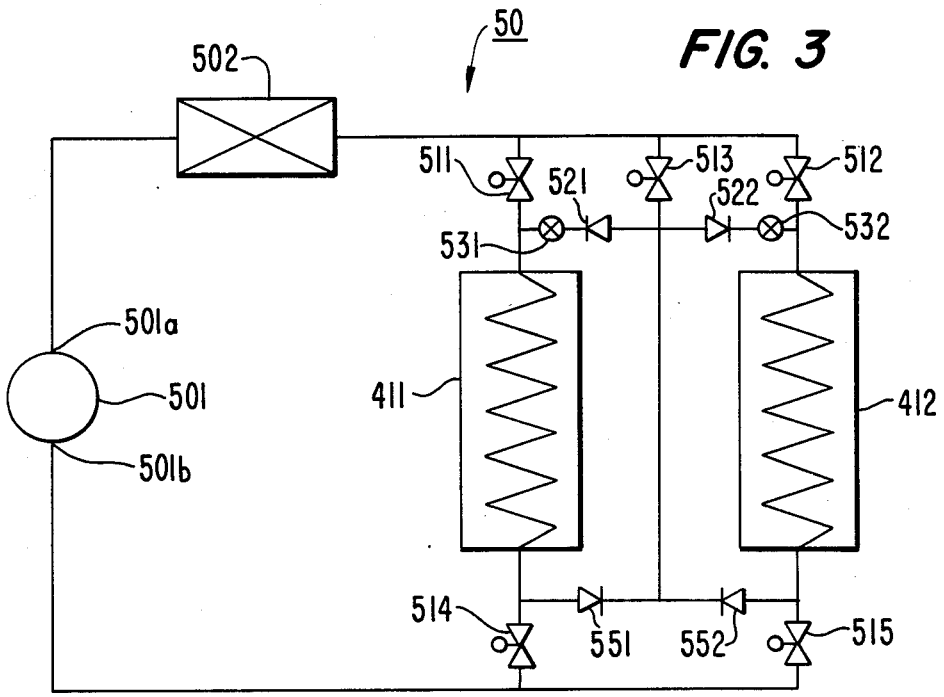
FIG. 3
FIG. 4
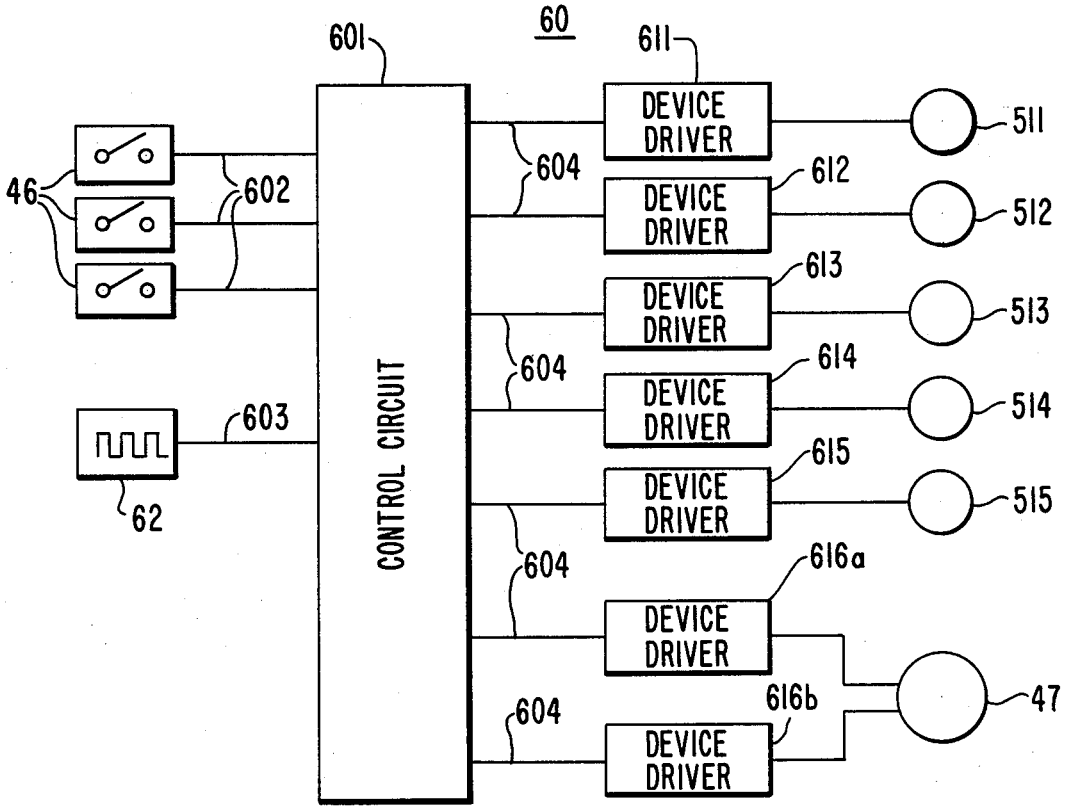

CONTROL DEVICE FOR REFRIGERATED DISPLAY CASE

TECHNICAL FIELD

This invention relates to the field of refrigeration systems such as may be used in a merchandise display case and, more particularly, is directed to a control device for such a system.

BACKGROUND OF THE INVENTION

Refrigerated display cases which have a front opening portion are well known in the prior art. In the prior art, multiple air curtain construction is utilized in the display case to isolate the refrigerated space from the ambient atmosphere. In this way, the refrigerated foods or the like can be easily removed from and replaced in the refrigerated display case. The display case employs an innermost air curtain and a second adjacent air curtain which are normally circulated within the display case through conduits provided therein. The innermost air curtain is normally the coldest and the second curtain is somewhat warmer. A refrigerating means, typically in the form of one or more evaporators, is located within the innermost curtain passage for cooling the air flowing therethrough.

In this type of refrigerated display case, the innermost curtain passage and the refrigerating means must be frequently defrosted to remove the accumulated frost on the evaporators collected from the cooled air which impedes the operation of the equipment. On a commercial unit, such a defrosting operation is achieved by the use of high voltage electrical heaters located adjacent to the evaporator of the refrigerating means, or in some instances, by passing a hot gas through the evaporator of the refrigerating means. However, the hot gas defrost method is complex in its construction and is practical in only a small percentage ofinstallations. With the electrical heater defrost, the refrigerating mechanism is temporarily heated while allowing the circulating air through the air curtains. Thus, the circulating air is warmed by the electrical heaters. The warm air can then melt the frost built up on the evaporator. It is important to melt this frost as rapidly as possible in order to minimize the temperature rise of the refrigerated foods and to minimize collection of frost on the refrigerated foods from the higher humidity in the recirculated warm air.

To resolve the above mentioned problems, a dual evaporating system is disclosed in copending and commonly assigned application Ser. No. 765,216, filed on Aug. 13, 1985, U.S. Pat. No. 4,633,677. Said application is incorporated herein by reference. The refrigerating means disclosed in application Ser. No. 765,216 includes two evaporators both of which are placed on respective air ducts. These ducts are positioned in line with the innermost air curtain flow and the evaporators are parallel and serial connected with one another by control valves which are operated in accordance with the storage space temperature and defrosting requirements of the evaporator. One of the two evaporators functions as an evaporator to refrigerate the passed air while the other evaporator is defrosted by hot gas. Therefore, defrosting of the evaporators can be achieved while maintaining the temperature in the storage space.

In the initial stage of operation of the refrigerating means, the temperature in the storage space is not cold. Therefore, the two evaporators are normally operated as heat exchanges to quickly cool the passed air for rapidly cooling the storage space. Also, in comparison with normal operation, initial start up of the refrigerating means is under a large load. This is because the two evaporators are started up at the same time. Therefore, the compressor in the refrigerating means has a large starting load. Under these conditions, the refrigerating system is not efficient to operate and is more likely to fail prematurely.

SUMMARY OF THE INVENTION

It is a primary object of this invention to provide an improved refrigerated display case which has an improved refrigerating means for effectively cooling the case without increasing of the size and power requirements of component parts of the refrigerating means.

It is another object of this invention to provide a refrigerated display case having an effective refrigerating means which reduces the starting load during initial operation of the refrigerating means.

It is still another object of this invention to provide a refrigerated display case which achieves the above objects while at the same time being simplier in construction and lower in cost than such display cases known in the prior art.

A refrigerating display case in accordance with this invention comprises an external housing, an internal housing within the external housing for storing merchandise, a front opening for access to the interior of the internal housing, a passage formed between the external and internal housings which includes inner and outer conduits interconnecting respective inlets and outlets extending across opposed edges of the front opening, a circulator for driving air through the passage between the outlets to the inlets in the form of inner and outer air curtains, and refrigerating means in the inner conduit for refrigerating the inner curtain of air.

The refrigerating means includes a compressor, a condenser and two evaporators. The inlet side of both evaporators are connected with one another by a first passage line in which first and second expansion devices with check valve elements are serially disposed. The ends of the first passage line communicates with the compressor through respective first and second valve devices. The outlet sides of both evaporators are also connected with one another by a second passage line in which third and fourth valve devices are serially disposed and respectively connected to the compressor. The first and second passage lines are connected with one another and connected to the condenser through a fifth valve device. The flow path for the refrigerant in the refrigerating means can be controlled by operation of the valve devices to accomplish three different modes of operation, i.e., an all refrigerating mode and two different types of refrigerating and defrosting modes.

A control device for the refrigerating means includes a driver circuit which controls the operation of the valve devices to establish a desired operating mode and a control circuit for regulating the operation of driver circuit in accordance with a predetermined program. The control device controls the refrigerating and defrosting modes of operation during the initial start up time of the refrigerating means.

Further objects, features and other aspects of this invention will be understood from the detailed description of the preferred embodiments of the invention with reference to the attached drawings.

BRIEF DESCRIPTION OF THE DRAWINGS

FIG. 3 is a mechanical block diagram of a refrigeration system in accordance with the present invention.

FIG. 4 is a block diagram of the control device used in the refrigeration system of the present invention.

DETAILED DESCRIPTION OF THE PREFERRED EMBODIMENTS

Figure 1:
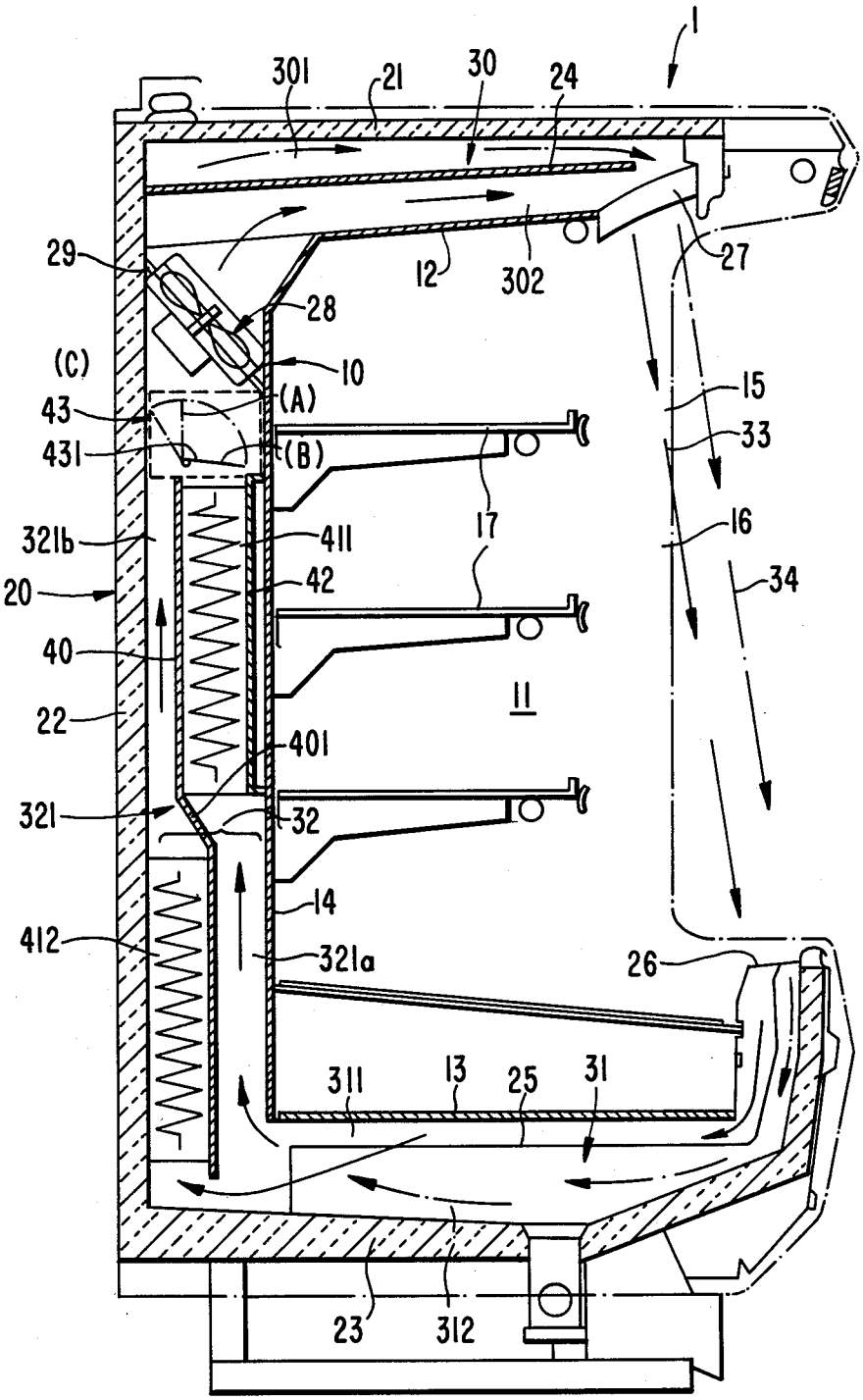
FIG. 1 is vertical section view of a refrigerated display case provided with a refrigeration system in accordance with one embodiment of the present invention.
Figure 2:
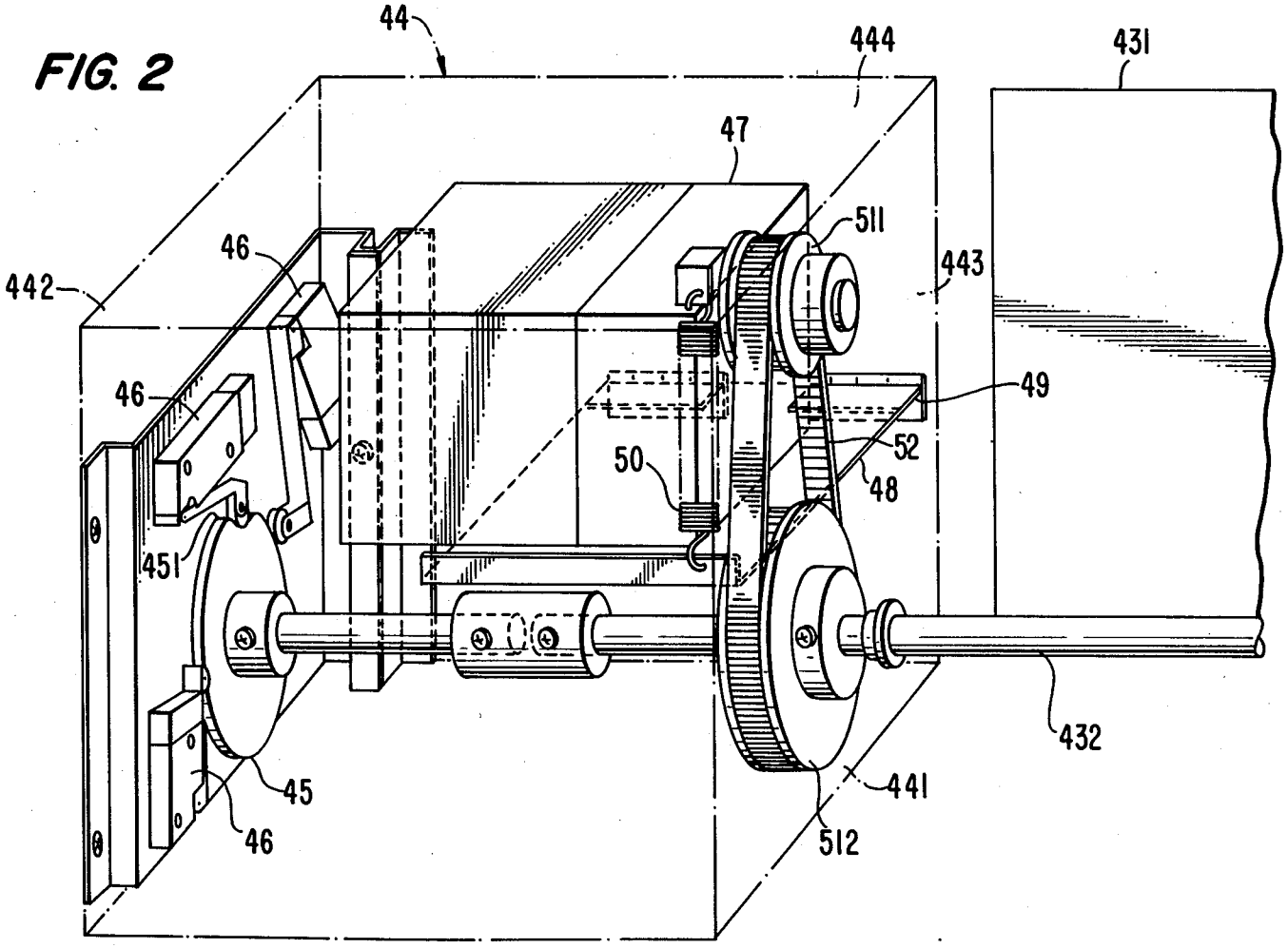
FIG. 2 is a perspective view of a damper box utilized in the refrigerated display case of FIG. 1.

Referring to FIGS. 1–3, a refrigerated display case 1 in accordance with one embodiment of this invention is shown. The refrigerated display case 1 comprises an interior cabinet 10 with a display space 11 and an exterior cabinet 20. Interior cabinet 10 is defined by an upper panel 12, a bottom panel 13 and a rear panel 14 extending upwardly between the upper and bottom panels 12, 13. Display space 11 is bounded on the side by a pair of side wall panels 15 (only one side panel 15 is indicated in FIG. 1 by a two-dot chain line). Display space 11 has a front opening 16 at its front side to easily access the interior of display space 11 from the ambient atmosphere. Furthermore, display space 11 is divided into sections by a plurality of vertically spaced, generally horizontal, shelves 17 which are mounted, preferably adjustably, on suitable uprights at rear panel 14.

The exterior cabinet 20 of case 1 is defined by a top member 21, a vertical rear wall 22 and a bottom member 23, each of which is usually formed of an insulation material. The space between the panels of interior cabinet 10 and the exterior cabinet 20 forms a plurality of air flow passages which define the multiple air curtains. In the space between the top member 21 and the upper panel 12, is disposed an upper divider panel 24 which horizontally divides the space 30, i.e., the upper space 30 is divided into two passage spaces, an upper passage space 301 and a lower passage space 302. The bottom space 31 between bottom panel 13 and bottom member 23 is also horizontally divided into two chambers or passage spaces by lower divider panel 25, i.e., an upper passage space 311 and lower passage space 312.

The space 32 formed between rear panel 14 and vertical rear wall 22 is divided by two separator plates (not shown) to form three passage spaces or conduits which are transversely parallel with one another. The center passage 321 of the three passages is connected with the lower passage space 302 of upper space 30 and upper passage space 311 of bottom space 31 to form a first air circulating passage. Both of the side passages of the three passages are connected with upper passage space 301 of upper space 30 and lower passage space 312 of bottom space 31 to form a second air circulating passage. Air inlets 26 are provided for each of the air circulating passages. The streams 33 and 34 which cross the front opening 16 of display space 11, pass into these inlets 26 and are driven through the passages to outlets 27 which are formed on the discharge opening of upper space 30, thus forming a clockwise circulation path as shown in FIG. 1 by the solid and dot and line arrows.

As mentioned above, the first air circulating passage is formed around display space 11, and the refrigerated air flowing through the first air culculating passage forms an enclosing air curtain across front opening 16 of display space 11. The second air circulating passage is also defined by the outer positioned passage spaces of the upper and bottom spaces and rear space 32. The inlet and outlet of the second air circulating passage are placed adjacent to and outwardly of the inlet and outlet of the first air circulating passage to form the second air stream 34. During normal operation, air is circulated through the first and second air circulating passages by a plurality of motor operated fans 28 disposed in the upper portion of rear space 32. These fans 28 cause the air circulation through the first and second air circulating passages. The temperature of the air passing through the second air circulating passage is slightly higher than the temperature of the air passing through the first air circulating passage but is below the temperature of the ambient atmosphere. Therefore, the air curtain created by the second air circulating passage prevents the temperature of the first air circulating passage from being reduced.

The center passage 321 of rear space 32, which is a component of the first air circulating passage, i.e., inner passage or chamber 321*a* and outer passage chamber 321*b*. An enlarged portion is formed on the upper portion of inner passage 321*a* and the lower portion of outer passage 321*b* by step portion 401 of partition plate 40. Evaporators 411, 412 are disposed in the enlarged portion of each passage 321*a*, 321*b*, respectively, and are disposed out of alignment with one another by the disposition of step portion 401. First evaporator 411, disposed in inner passage 321*a*, is fixed between the partition plate 40 and an attached plate 42 and second evaporator 412, disposed in outer passage 321*b*, is fixed between partition plate 40 and vertical rear wall 22. The attached plate 42 is fastened on rear panel 14 and extends across the side surface of first evaporator 411 to cover the side surface so as to prevent the leakage of unrefrigerated air. Damper box 43, which includes a shutter plate 431, is disposed on the upper portion of the center passage 321 to cover the discharge opening of the inner and outer passage 321*a* and 321*b* and control the opening and closing of the discharge opening. Fan attachment plate 29, which has a plurality of holes to fasten the motor driven fan 28, is disposed above damper box 43 and extends over the upper portion of rear space 32.

As illustrated in FIG. 2, damper box 43 is provided with motor box 44 into which one end portion of support shaft 432 horizontally extends. The end of support shaft 432 is rotatably supported on both side plates 441 and 442 of motor box 44. A cam plate 45, which has a plurality of depressions 451 at its outer peripheral portion, is fixed on an outer terminal end of support shaft 432, and microswitches 46 are disposed adjacent to depressions 451, to determine the rotating range of support shaft 432 and define the position of shutter plate 431. Motor 47 is placed on a motor support plate 48 of which one end portion is fastened to rear plate 443 of motor box 44 through hinge element 49 for enabling rotating motion within a limited range. The other end of motor support plate 48 is supported on upper plate 444 of motor box 44 through spring 50 which pulls the support plate 48 away from the support shaft 432. Motor 47 is connected with support shaft 432 through a pair of teeth from pulleys 511 and 512, each of which is attached to motor 47 or support shaft 432 and belt 52, to transmit the rotating motion of motor 47 to support shaft 432.

As to the operation of motor box 44, shutter plate 431 of damper box 43 is placed on one of the three different positions (these positions are indicated by A, B, C in FIG. 1). If shutter plate 431 is positioned in the middle of the discharge opening (this position is indicated by A), air can pass through both passages 321*a*, 321*b* and is cooled by the heat exchange action of the first and second evaporators 411, 412. On the other hand, if shutter plate 431 is placed on the right side in FIG. 1 to cover the discharge opening of inner passage 321*a* (this position is indicated by B), the air flow through inner passage 321*a* is intercepted by shutter plate 431 to thereby promote the defrosting operation of first evaporator 411 while the circulation and cooling of the air in the first air circulating passage continues via outer passage 321*b*. Conversely, if shutter plate 431 is placed on the left side in FIG. 1 to cover the discharge opening of outer passage 321*b* (this position is indicated by C), the air flow through outer passage 321*b* is intercepted while the circulation and cooling of the air in the first air circulating passage continues via innter passage 321*a* to thereby promote the defosting operation of second evaporator 412 while continuing to cool the air passed through the first air circulating passage.

With reference to FIG. 3, a refrigerating means 50 used in the refrigerated display case 1 of FIG. 1 comprises a compressor 501, a condensor 502 and the two evaporators 411 and 412. Each of these components is serially connected with one another to form a closed loop refrigerating circuit. That is, the discharge port 501*a* of compressor 501 is connected with the inlet side of condenser 502. The outlet line from condenser 502 is provided with three terminals, each of which receives a respective magnetic valve 511, 512 and 513. First magnetic valve 511 is connected to the inlet side of the first evaporator 411 and second magnetic valve 512 is connected to the inlet side of the second evaporator 412. The third magnetic valve 513 is connected to the inlet side of both the first and second evaporators 411 and 412 through check valves 521, 522, respectively. Check valves 521, 522 prevent the flow of refrigerant from the inlet sides of evaporators 411, 412 through expansion valves 531, 532, respectively. Expansion valves 531, 532 are preferably thermal automatic expansion type valves.

The outlet side of each of evaporators 411, 412 is connected to suction port 501*b* of compressor 501 through fourth and fifth magnetic valves 514, 515, respectivley. Further, both outlet sides of evaporators 411, 412 are connected with one another through check valves 551 and 552. Check valves 551, 552 prevent the flow of refrigerant into evaporators 411, 412. The connection point between opposed check valves 551, 552 is connected to the connection point between check valves 521 522.

With respect to the operation of refrigerating means 50, when the first and second magnetic valves 511, 512 are closed and the remaining three magnetic valves 513, 514 and 515 are opened, refrigerant flows into both the first and second evaporators 411, 412 through expansion valves 531 and 532, respectively, i.e., the two evaporators 411 and 412 are placed on line in refrigerating means 50 by means of a parallel connection. The situation is referred to as the "first mode" of operation. In the first mode operation, shutter plate 431 in damper box 43 is positioned at midway position A to open both discharge openings of the inner and outer passages 321*a*, 321*b*. Therefore, both evaporators 411, 412 are functioning in order to cool the circulating air passed through both evaporators and is returned to suction port 501*b* of compressor 501 through the open fourth and fifth magnetic valves 514, 515.

In the "second mode" of operation, the second and fourth magnetic valves 512 and 514 are the only valves opened. Thus, the inlet line of second evaporator 412 is connected with condenser 502 and the outlet line of the first evaporator 411 is connected with suction port 501*b* of compressor 501. Thus, both evaporators 411 and 412 are serially connected in the refrigerating means. In the second mode of operation, shutter plate 431 is moved to position C to close the discharge opening of outer passage 321*b*. In this condition, since the refrigerant is passed through expansion valve 531 before flowing into first evaporator 411, the refrigerant is expanded only while passing through the first evaporator 411 to achieve a heat exchange action and subsequent cooling. However, since the refrigerant passes through the second evaporator 412 at elevated temperature and pressure, evaporator 412 is defrosted. Thus, while one evaporator is being used to cool the circulating air passing through inner passage 321*a*, the other evaporator is being defrosted.

In the "third mode" of operation, only the first and fifth magnetic valves 511, 515 are opened. Thus, the inlet line of first evaporator 411 is connected with condensor 502 and the outlet line of the second evaporator 412 is connected with the suction port 501*b* of compressor 501. In this situation, both evaporators 411, 412 are serially connected with one another. In this mode, the hot refrigerant is passed through first evaporator 411 and is thereafter expanded through expansion valve 532 into second evaporator 412 to achieve heat exchange with and cooling of the circulating air. Thus, first evaporator 411 is defrosted and second evaporator 412 cools the circulated air passing through outer passage 321*b*. In the second mode of operation, shutter plate 431 in damper box 43 is moved to position B.

In the above construction of the refrigerating means, changing from defrosting one evaporator to defrosting the other evaporator could result in the refrigerating mode of both evaporators being by-passed. For example, if the magnetic valves which are disposed on the inlet and outlet lines of the defrosted evaporator opened, liquid refrigerant which flows through the defrosted evaporated can be directly returned to the suction side of compressor 501. This situation, however, can lead to several problems, including destruction of the compressor. Thus, during a change of operating modes, the liquid refrigerant should be passed through the expansion valve leading to another evaporator to be vaporized. Thus, a change from the second operating mode to the first operating mode can be safely achieved by briefly entering a "fourth mode" of operation where second magnetic valve 512 is closed and fourth magnetic valve 514 is maintained open to pass the liquid refrigerant in second evaporator 412 through expansion valve 531. On the other hand, a change from the third operating mode to the first operating mode can be safely achieved by briefly entering a "fifth mode" of operation where first magnetic valve 511 is closed and fifth magnetic valve 515 is maintained open to pass the liquid refrigerant in first evaporator 411 through expansion valve 532.

With reference to FIG. 4, control device 60 for motor 47 which drives shutter plate 431 and magnetic valves 511–515 of refrigerating means 50 will be described. Control device 60 includes a control circuit 601 which can be a logic circuit or microprocessor which executes the steps shown in the flow chart in FIG. 5. Control circuit 601 receives several input signals 602 which indicate the ON-OFF state of microswitches 46 disposed around cam plate 45 of motor box 44 and a timer signal 603 from timer element 62. Control circuit 601 also provides output control signals 604 which are coupled to a device driver 611–615, 616*a* and 616*b*. Device driver 611–615 control the opening and closing of magnetic valves 511–515 while device drivers 616*a* and 616*b* control the operation of motor 47 (FIG. 2).

When electrical power is supplied to control device 60, ON-OFF signals 602 from microswitches 46 are provided to control circuit 601 to indicate the position of shutter plate 431. If signals 602 indicate that shutter plate 431 is placed at position B (FIG. 1), the first and fifth magnetic valves 511, 515 are operated to open the refrigerant line by output signals 604 from control circuit 601 to device drivers 611 and 615. Thus, the operation of the refrigerating means is started in the third mode of operation. Operation in this mode is continued for at least five (5) minutes. If shutter plate 431 is indicated by signals 602 as being in position C at the initial start up of operation, the second and fourth magnetic valves 512, 514 are operated to open the refrigerant line by output signals 604 from control circuit 601 to device drivers 612 and 614. Thus the operation of the refrigerating means is started up in the third mode of operation. Operation in this mode also continues for at least five (5) minutes.

If shutter plate 431 is not at either position B or position C at the initial start up stage of operation, motor 47 is turned on by output signals 604 from circuit 601 to device drivers 616*a* and 616*b*. Motor 47 is operated to drive shutter plate 431 to position B or position C. Motor 47 may be operated in either a clockwise or a counter-clockwise direction. After shutter plate 431 reaches position B or position C, the operation of the control circuit and refrigerating means is the same as that described above. Thus, the refrigerating means is operated in either the second or third mode during the initial start up stage for a predetermined time (at least 5 minutes).

The duration of output signals 604 from control circuit 601 for controlling the operation of the magnetic valves and motor through the device drivers is determined by time signals 603 from time element 62. Thus, time element 62 may be used to alternatively change the mode of operation of the refrigerating means and to determine the operating time for each mode and the timing of the motor. For example, operation in the third mode may be continued for a first predetermined time, i.e., thirty (30) minutes, followed by operation in the fifth mode for a second predetermined time, i.e., five (5) minutes, before transfer to the first operating mode. Operation continues in the first mode for a third predetermined time, i.e., fifty-five (55) minutes before being transferred to the second mode for a fourth predetermined time, i.e., thirty (30) minutes. Thereafter, the mode of operation may be changed to the first mode after passing through the fourth mode of operation for a brief period, i.e., five (5) minutes. After a predetermined period of operation in the first mode, i.e., fifty-five (55) minutes operation may be transferred to the third mode, thereby completing one cycle of operation.

Figure 5:
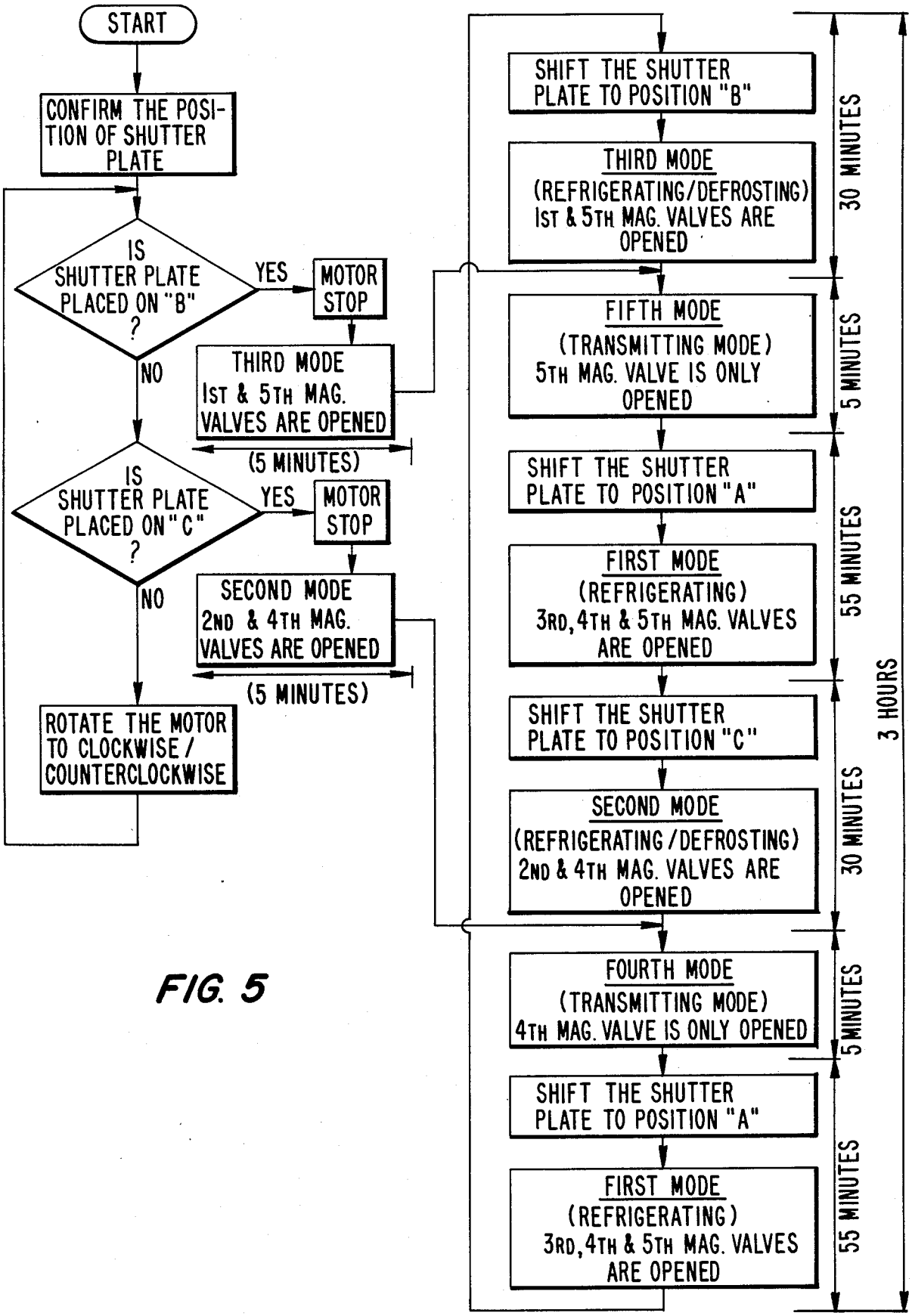
FIG. 5 is a flow chart illustrating the control steps executed by the control device shown in FIG. 4.

FIG. 5 is a flow chart illustrating the above described start-up sequence and one complete cycle through each operating mode.

As mentioned above, during the initial stage of start-up, the refrigerating means is operated in the second or third mode of operation. Therefore, the initial power load required by the refrigerating means is greatly reduced.

This invention has been described in detail in connection with the preferred embodiments. These embodiments, however, are merely illustrative and the present invention is not restricted thereto. It will be easily understood by those skilled in the art that other variations and modifications can be easily made, particularly in matters of size, shape and arrangement of parts, within the scope of this invention, as defined by the broad general meaning of the terms in which the appended claims are expressed.

What is claimed is:

1. In a refrigerated display case comprising an external housing, an internal housing within the extension housing for storing merchandise, a front opening for access to the interior of said internal housing, passage means formed between said external and internal housing which includes inner and outer conduits interconnecting respective inlets and outlets extending across opposed edges of said front opening, circulating means for driving air around said passage means through said conduits in the form of inner and outer air curtains and a refrigeration unit to cool said display case, said refrigeration unit having a compressor, a condenser and first and second evaporators, the improvement comprising:

said first evaporator being disposed in said inner conduit;

said second evaporator being disposed in said outer conduit, the inlet side of said first evaporator being coupled to the inlet side of said second evaporator by a first passage line in which the outlet side of said first evaporator being coupled to the discharge side of said second evaporator by a second passage line in which third and fourth check valves are disposed in series, said first and second passage lines being connected to each other by a third passage line;

said condenser being coupled to the inlet side of said first and second evaporators and said first and third passage lines by a plurality of valve devices;

said compressor having its discharge side coupled to the inlet side of said condenser and its suction side connected to the outlet sides of said first and second evaporators through a plurality of valve devices; and control means for controlling the operation of said refrigeration unit by operating said first and second evaporators in series and in parallel in accordance with a predetermined program.

2. The refrigerated display case of claim 1 wherein said predetermined program includes a first operating mode during which said first and second evaporators are operated in parallel, said parallel operation being accomplished by said control means controlling the operation of said plurality of valve devices on the inlet and outlet sides of said first and second evaporators.

3. The refrigerated display case of claim 1 wherein said predetermined program includes a plurality of operating modes during which said first and second evaporators are operated in series, said series operation beng accomplished by said control means controlling the operation of said plurality of valve devices on the inlet and outlet sides of said first and second evaporators.

4. The refrigerated display case of claim 3 wherein one of said plurality of operating modes is a second operating mode wherein said control means controls the the operation of said plurality of valve devices on the inlet and outlet sides of said first and second evaporators such that the refrigerant passing through said second evaporator is at elevated temperature and pressure to thereby defrost said second evaporator.

5. The refrigerated display case of claim 3 wherein one of said plurality of operating modes is a third operating mode wherein said control means controls the operation of said plurality of valve devices on the inlet and outlet sides of said first and second evaporators such that the refrigerant passing through said first evaporator is at elevated temperature and pressure to thereby defrost said first evaporator.

6. The refrigerated display case of claim 3 wherein some of said plurality of operating modes are change-over operating modes which occur at the end of a prior operating mode and before subsequent operating mode, wherein said control means controls the operation of said plurality of valve devices on the inlet and outlet sides of said first and second evaporators such that the refrigerant passing through one of said first and second evaporators passes through one of said first and second expansion valves before passing through the other of said first and second evaporators.

7. The refrigerated display case of claim 6 wherein one of said change-over operating modes is a fourth operating mode wherein said control means controls the operation of said plurality of valve devices on the inlet and outlet sides of said first and second evaporators such that the refrigerant passing through said second evaporator is passed through one of said first and second expansion valves before passing through said first evaporator.

8. The refrigerated display case of claim 6 wherein one of said change-over operating modes is a fifth operating mode wherein said control means controls the operation of said plurality of valve devices on the inlet and outlet sides of said first and second evaporators such that the refrigerant passing through said first evaporator is passed through one of said first and and second expansion valves before passing through said said first and second evaporators such that the refrigerant passing through second evaporator.

9. The refrigerated display case of claim 2 wherein said predetermined program includes second and fourth operating modes, wherein during said second operating mode, said control means controls the operation of said plurality of valve devices on the inlet and outlet sides of said second evaporator is at elevated temperature and pressure to thereby defrost said second evaporator, during said fourth operating mode said control means controls the operation of said plurality of valve devices on the inlet and outlet sides of said first and second evaporators such that the refrigerant passing through said second evaporator is passed through one of said first and second expansion valves before passing through said first evaporator, said fourth operating mode occurring after said second operating mode and before said first operating mode.

10. The refrigerated display case of claim 2 wherein said predetermined program includes third and fifth operating modes, wherein during said third operating mode, said control means controls the operation of said plurality of valve devices on the inlet and outlet sides of said first and second evaporators such that the refrigerant passing through said first evaporator is at elevated temperature and pressure to thereby defrost said first evaporator, during said fifth operating mode said control means controls the operation of said plurality of valve devices on the inlet and outlet sides of said first and second evaporators such that the refrigerant passing through said first evaporator is passed through one of said first and second expansion valves before passing through said second evaporator, said fifth operating mode occurring after said third operating mode and before said first operating mode.

11. The refrigerated display case of claim 1 further including damper means for controlling the flow of air through said inner and outer conduits, said damper means being controlled by said control means to selectively close off the flow of air through said inner and outer conduits.

12. The refrigerated display case of claim 2 further including damper means for controlling the flow of air through said inner and outer conduits, said damper means being controlled by said control means to selectively close off the flow of air through said inner and outer conduits, during said first mode of operation, said damper means permitting the flow of air through said inner and outer conduits.

13. The refrigerated display case of claim 4 further including damper means for controlling the flow of air through said inner and outer conduits, said damper means being controlled by said control means to selectively close off the flow of air through said inner and outer conduits, during said second operating mode said damper means preventing the flow of air through said inner conduit while permitting the flow of air through said outer conduit.

14. The refrigerated display case of claim 5 further including damper means for controlling the flow of air through said inner and outer conduits, said damper means being controlled by said control means to selectively close off the flow of air through said inner and outer conduits, during said second operating mode said damper means preventing the flow of air through said outer conduit while permitting the flow of air through said inner conduit.

15. The refrigerated display case of claim 11 wherein said damper means includes a shutter member driven by an electric motor, the shaft of said motor being coupled to feedback means for providing feedback signals to said control means, said feedback signals being used by said control means to control the operation of said damper means.

16. The refrigerated display case of claim 15 wherein said feedback means is formed of a cam driving a plurality of microswitches.

17. The refrigerated display case of claim 4 wherein said control means switches the operation of said refrigeration circuit between said first operating mode and said second operating mode in accordance with a predetermined program.

18. The refrigerated display case of claim 5 wherein said control means switches the operation of said refrigeration circuit between said first operating mode and said third operating mode in accordance with a predetermined program.

* * * * *